United States Patent [19]

Landry

[11] 4,316,341

[45] Feb. 23, 1982

[54] FIRING MECHANISM FOR SINGLE ACTION FIREARM

[75] Inventor: Archie C. Landry, Canoga Park, Calif.

[73] Assignee: North American Manufacturing Corp., Provo, Utah

[21] Appl. No.: 98,870

[22] Filed: Nov. 30, 1979

[51] Int. Cl.[3] ..... F41C 17/04

[52] U.S. Cl. ..... 42/70 F; 42/66

[58] Field of Search ..... 42/70 F, 70 R, 66

[56] References Cited

U.S. PATENT DOCUMENTS

| | | | |
|---|---|---|---|
| 566,393 | 8/1896 | Fyrberg | 42/66 |
| 644,660 | 3/1900 | Caldwell | 42/70 F |
| 649,809 | 5/1900 | Caldwell | 42/66 |
| 658,314 | 9/1900 | Bye | 42/66 |
| 911,362 | 2/1909 | Aubrey | 42/70 F |
| 933,188 | 9/1909 | Leggett | 42/66 |
| 3,157,958 | 11/1964 | Lewis | 42/70 F |
| 3,768,190 | 10/1973 | Ruger et al. | 42/66 |
| 3,777,384 | 12/1973 | Ruger et al. | 42/70 F |
| 3,988,848 | 11/1976 | Chatigny | 42/70 F |

*Primary Examiner*—Charles T. Jordan
*Attorney, Agent, or Firm*—Gene W. Arant

[57] ABSTRACT

A firearm has an external hammer that is manually cocked in order to rotate the trigger to its ready-to-fire position. The hammer has an elongated vertically extending recess formed therein, such that when the hammer is adjacent the firing pin, an end portion of the recess is juxtaposed to the firing pin, and the hammer does not engage the firing pin. An elongated safety member is disposed within the recess and movable between retracted and extended positions, the extended position being such that the hammer may drive the safety member into engagement with the firing pin, and the retracted position being such that the safety member cannot engage the end of the firing pin but may lodge beneath its under side. A cam carried by the trigger cooperates with the hammer for controlling the position of the safety member. During firing the safety member swings with the hammer, and the firing pin is actuated by the combined kinetic energies of both.

4 Claims, 18 Drawing Figures

12
11
14
10
20
23a
13
30
85
35
77
56
55
57
38
15

30
50
53
52
45a
35
15a
55
51
46
25
45
69
65
67
15b 30
50
45a
52
35
15a
55
51
46
25
45
69
53
65
67
15b
63

51
50
52

FIRING MECHANISM FOR SINGLE ACTION FIREARM

BACKGROUND OF THE INVENTION

1. Field of the Invention

The present invention relates to revolvers and other firearms having an external hammer, and in particular to a firing mechanism for such firearms having an improved safety characteristic.

2. Prior Art

The present invention relates to those firearms having an external hammer which must be manually cocked before the trigger can be pulled. The hammer is functionally incapable of being cocked simply by pulling the trigger, as is the case with double action firearms. Such firearms include single action revolvers, single shot rifles, and the like. All of these firearms share in common an external hammer having a sear notch that is engaged by the sear of the trigger when the hammer is cocked. Spring means turn the trigger so as to engage the sear in the sear notch.

Prior art patents include the following:

U.S. Pat. No. 566,393—Fyrberg
U.S. Pat. No. 658,314—Bye
U.S. Pat. No. 933,188—Leggett
U.S. Pat. No. 3,157,958—Lewis
U.S. Pat. No. 3,777,384—Ruger et al Each of these patents shows a safety bar which must be interposed between the hammer and the firing pin in order for a firing action to occur.

In Fyrberg the rearward motion of trigger D in the operation of releasing the hammer carries the pawl E upward, so as to bring the end E2 of the pawl into the path of the hammer and between the hammer face and the firing pin.

In Bye a sliding hammer-face I represents a safety member. J is the lifter or pawl hinged to the trigger for cocking the hammer by pull of the trigger. The hammer face I is raised directly by action of the pawl J. When the sliding hammer face is at depressed position, the front of the hammer presents a space into which the head of the firing pin is received without effecting contact therewith; but when elevated the hammer-face presents a solid portion that contacts with and forces forward the firing pin to discharge the cartridge.

In Leggett, during backward movement of the trigger to strike the sear, a lifting pawl 8 is raised from the notch 9 and its end 14 carried between the striking face of the hammer and the firing pin. From a firing position the lifting pawl 8 is free to move downward and allow the trigger to be returned to its normal position by the trigger spring.

In Lewis a safety member 23 has an impact portion 36 which is struck on one side by the hammer when the revolver is fired, its other side engaging the firing pin. As the hammer is cocked it carries the safety member 23 upwardly, and a dog 35 on the safety member is received in a cavity adjacent the firing pin which holds the safety member in place until the firing movement of the hammer is completed.

In Ruger et al, a vertically disposed trigger bar 34 is pivotally connected to a rearwardly extending trigger bar lifting arm of the trigger. The upper end portion 37 of the trigger bar 34 is disposed in front of the hammer 5 between the hammer and frame of the revolver, the trigger bar being movable vertically from its lower position to its upper position when the trigger is rotated from its reset position to its ready-to-fire position. In the embodiment shown by Ruger et al in FIGS. 14 through 16, when the hammer is at rest and the trigger bar is at its lower position, upward movement of the trigger bar is blocked by the rearward end of the firing pin.

In each of these prior patents the safety member or trigger bar is located between the cylinder housing of the firearm and the hammer.

SUMMARY OF THE INVENTION

According to the present invention an elongated recess is formed within the hammer, and an elongated safety member is disposed within that recess and is slidable therein between retracted and extended positions. When the hammer pivots forward to the firing position it does not itself directly engage the firing pin, but if the safety member is in its upwardly extended position it is driven onto the firing pin by the hammer and initiates firing of the cartridge. The firing pin is supported by its spring so that it normally projects rearwardly from the cylinder housing. If the hammer is in its forward position and the safety member is retracted to its lower position, the safety member cannot then engage the rear end face of the firing pin but instead engages the underside of the firing pin, thereby preventing the safety member from being raised to a position where the firearm may be fired.

Further according to the present invention, the raising or lowering of the safety member is controlled by a cam that is positioned beside the hammer. The safety member cam is secured to the trigger and is driven in its raising or lowering movements by the trigger.

When the hammer is cocked, the relative pivotal movement between hammer and trigger causes the safety member cam to raise the safety member to its extended or firing position. It is then necessary to pull the trigger, and to maintain a pulling force on the trigger while both the hammer and the safety member swing forward to the firing position. If the pulling force on the trigger is not maintained while the hammer is swinging forward, the safety member may slip downward to its retracted position and thereby prevent the firing of the cartridge.

Also in accordance with the invention, after the weapon has been fired and the trigger is released, the trigger spring pivots the trigger to its safety position, thereby causing the safety member cam to withdraw the safety member from its extended position to its retracted position. If the trigger is again pulled with the hammer forward the result is to engage the upper end of the safety member against the underside of the firing pin, but no firing action takes place.

A particular feature of the present invention is that the firing action is initiated not only by the kinetic energy of the hammer, but also by the kinetic energy of the safety member, since the safety member swings forward in synchronism with the hammer.

SEPARATE INVENTIONS

Other separate and independent inventions are also disclosed and claimed in the present application.

One such separate invention is a safety interlock between the loading gate, cylinder latch and hammer, which makes it possible to eliminate the separate loading position of the hammer that has conventionally been incorporated in single action firearms. One special feature of the mechanism prevents the loading gate from being opened except when the hammer is in its safety position; and when the hammer is in its safety position and the loading gate is opened another special feature of the mechanism then operates in response to the movement of the loading gate to disengage the cylinder latch so that the cylinder may then be rotated for loading all of its chambers.

Another separate and independent invention disclosed and claimed in the present application relates to an improved means for disengaging the cylinder latch whenever the hammer is cocked. In accordance with this mechanism a latch cam extends beside the hammer and is pivotally movable in a plane parallel to the plane of movement of the hammer. A cam button carried in a lateral hole in the hammer normally extends into the movement plane of the latch cam. The latch cam has a shoulder, which in the forward position of the hammer, extends across the movement path of the cam button. When the hammer is moved towards its cocked position the cam button engages the aforesaid shoulder and pivots the latch cam against the force of its spring so as to disengage the cylinder latch. The cam button also engages another portion of the latch cam shoulder with a sloped surface, however, so that further movement of the hammer towards its fully cocked position causes the cam button to be laterally retracted against the force of a retaining spring out of the plane of the latch cam, and the cam button then slides along a side surface of the latch cam. This mchanism provides a very positive and reliable action for unlatching the cylinder.

DRAWING SUMMARY

FIG. 1 is a side elevation view of a hand gun in accordance with the present invention, shown partially cut away;

DETAILED DESCRIPTION

Figures 4, 10, 11, 12:
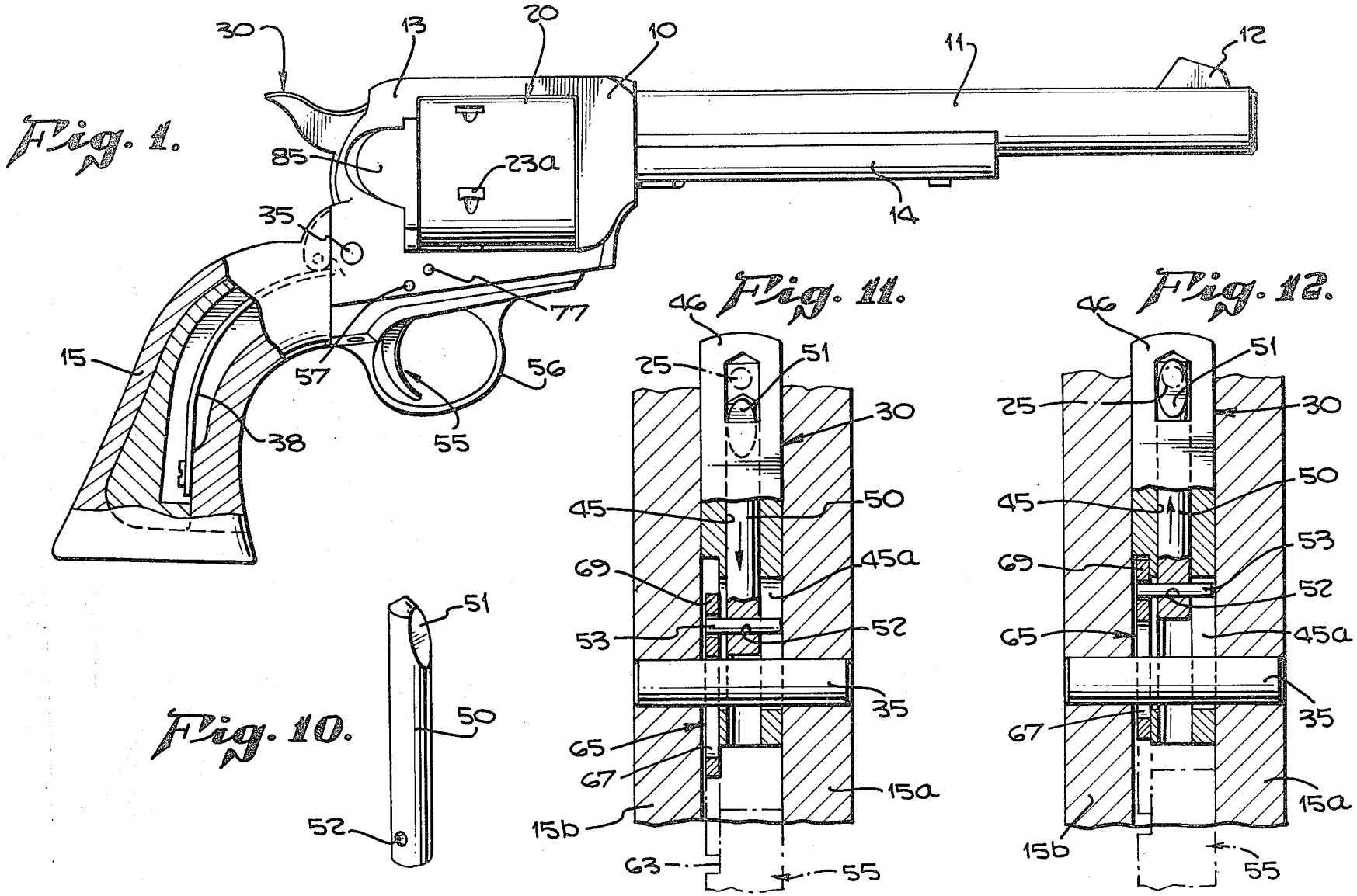
FIG. 4 is a view like FIG. 3 showing the hammer moved to a still more rearward position.
FIG. 10 is a perspective view of the safety member or auxiliary firing pin.
FIG. 11 is a transverse cross-sectional view taken on the line 11—11 of FIG. 2 and showing the upper end of the safety member positioned beneath the firing pin.
FIG. 12 is a view like FIG. 11, taken on line 12—12 of FIG. 6, and in which the upper end of the safety member is seen to cover the firing pin.

Reference is now made to the drawings, FIGS. 1 to 18, inclusive, illustrating the presently preferred form of the invention.

Frame Assembly

As best seen in FIG. 1, the invention is incorporated in a single action firearm of generally conventional appearance. A central frame 10 has a barrel 11 projecting forwardly from it. A front sight 12 is provided on the forward end of the barrel and a rear sight 13 is provided at the rear of the frame 10. Cylinder 20 is revolubly carried in the frame 10. An ejector tube 14 located below and to one side of the barrel 11 may be conventional in its construction and operation. Hammer 30 is positioned behind the main frame 10. A loading gate 85 is positioned behind the right-hand side of cylinder 20, which is the side seen in FIG. 1. Trigger 55 projects beneath the central frame 10 and is protected by trigger guard 56. A curved handle 15 extends rearwardly and downwardly from the main frame 10.

Cylinder Assembly

Figure 2:
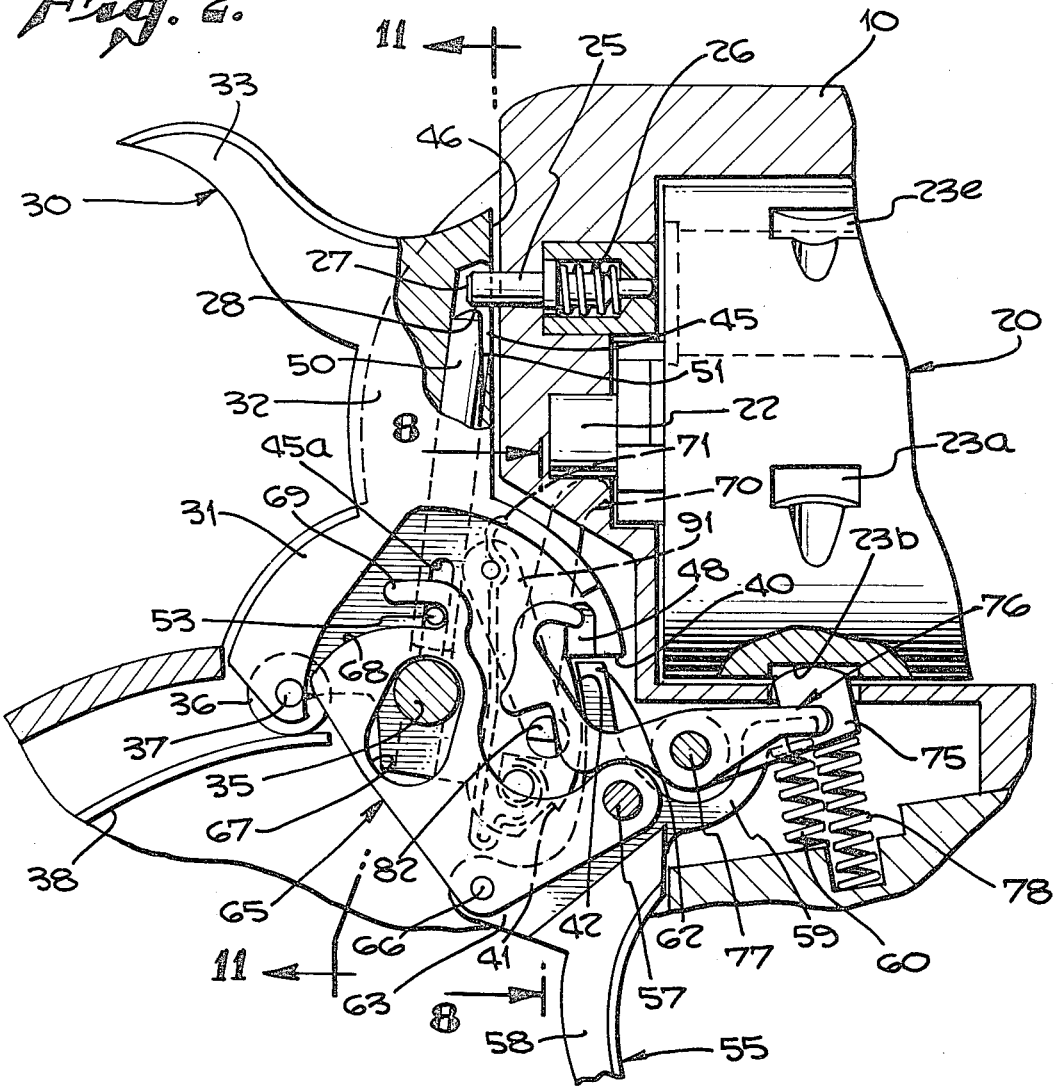
FIG. 2 is a cross-sectional elevational view showing the firing mechanism of the gun when in the safety or stored position.
Figure 6:
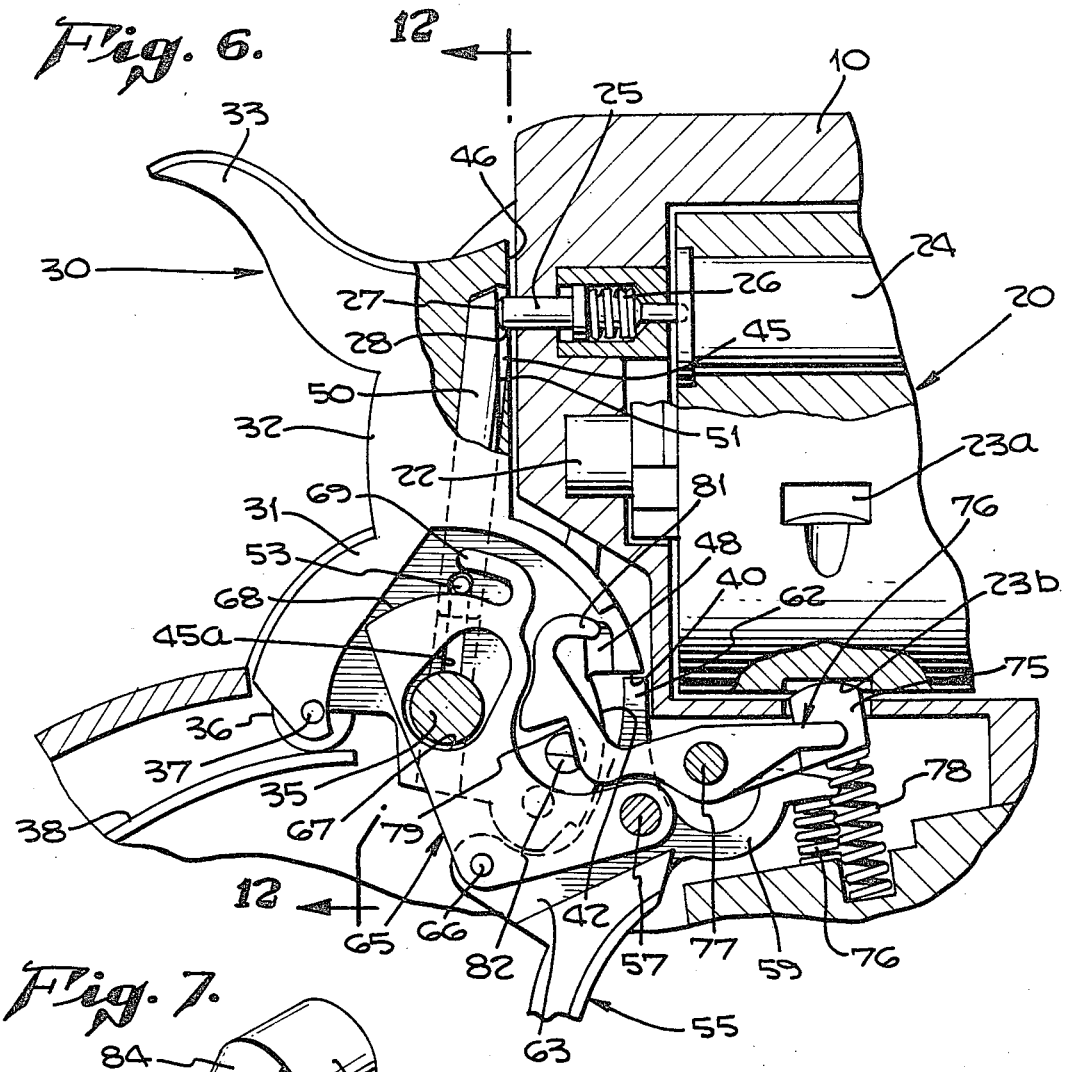
FIG. 6 shows the firing mechanism in the firing position, after the trigger has been pulled and the hammer and safety member have moved to their fully forward position.
Figure 13:
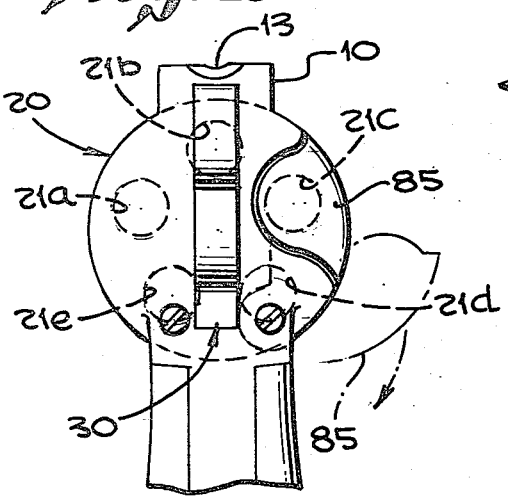
FIG. 13 is a rear elevation view of the cylinder, loading gate, and hammer.

Cylinder 20 contains five firing chambers 21*a* . . . 21*e* as best seen in FIG. 13. It rotates about its longitudinal axis and is journaled on bearings 22, the rear one of which is seen in FIGS. 2 and 6. Around its exterior periphery the cylinder has a series of five notches 23*a* . . . 23*e* which are engaged by the cylinder latch to be subsequently described, for locking the cylinder in a particular position of rotation. The cylinder also has a set of end notches on its rearward end, not specifically shown, which are used for drivingly rotating the cylinder from one chamber position to the next.

Firing Pin and Spring

Firing pin 25 is carried in the central frame 10 immediately behind and in alignment with the uppermost one of the chamber positions of the cylinder. See FIGS. 2 and 6. As shown in FIG. 2 the firing pin spring 26 normally urges the firing pin to protrude a substantial distance rearwardly of the frame 10, so that not only is the rear end face 27 of the firing pin exposed but also the underside 28 of the firing pin is equally exposed. In the firing position as shown in FIG. 6, however, the forward end of the firing pin enters the rear end surface of a cartridge 24 that has been loaded in the firing chamber, thereby causing firing of the cartridge.

Hammer Assembly

Figure 5:
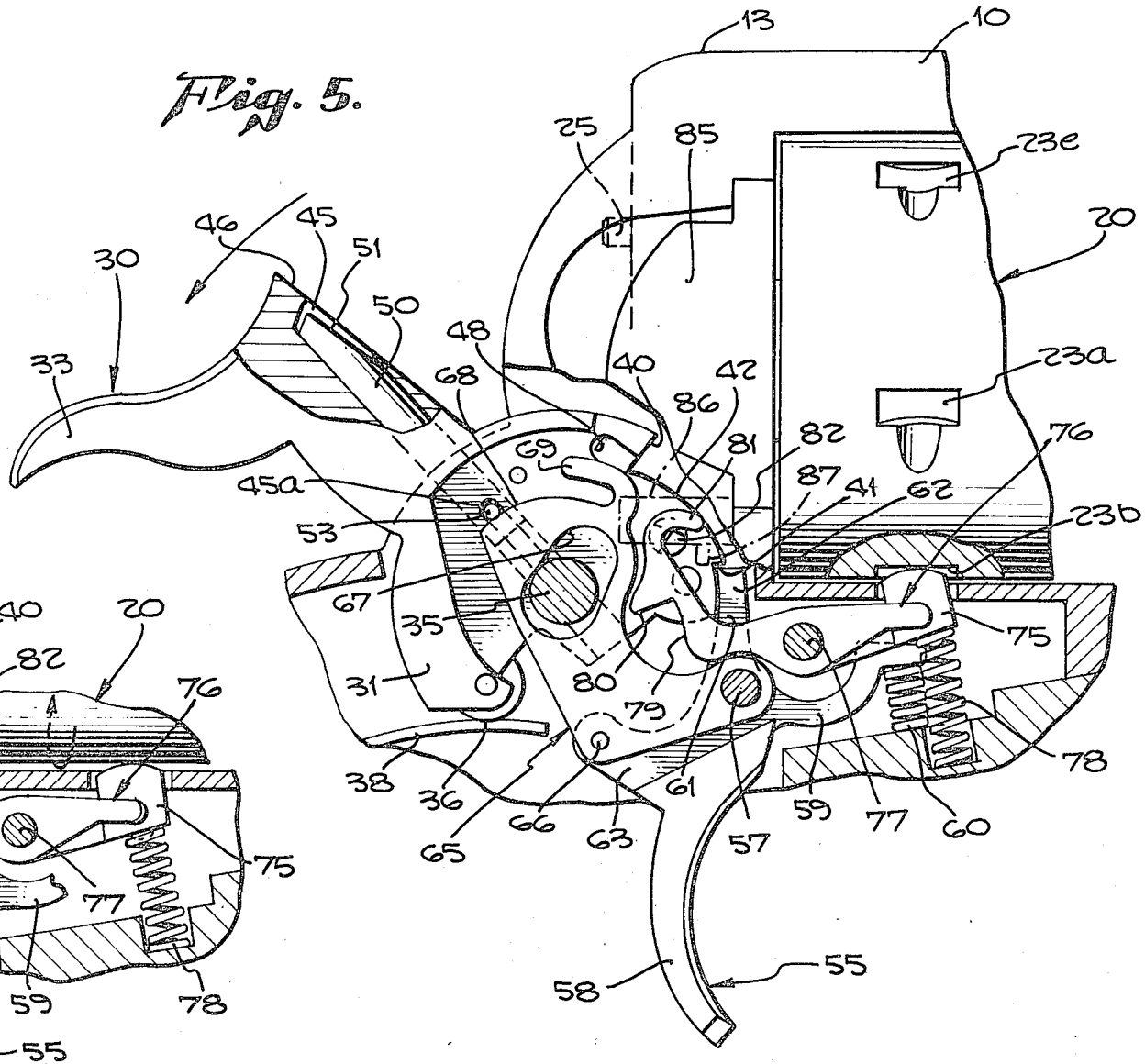
FIG. 5 is a cross-sectional elevational view showing the firing mechanism in the fully cocked position.
Figure 4:
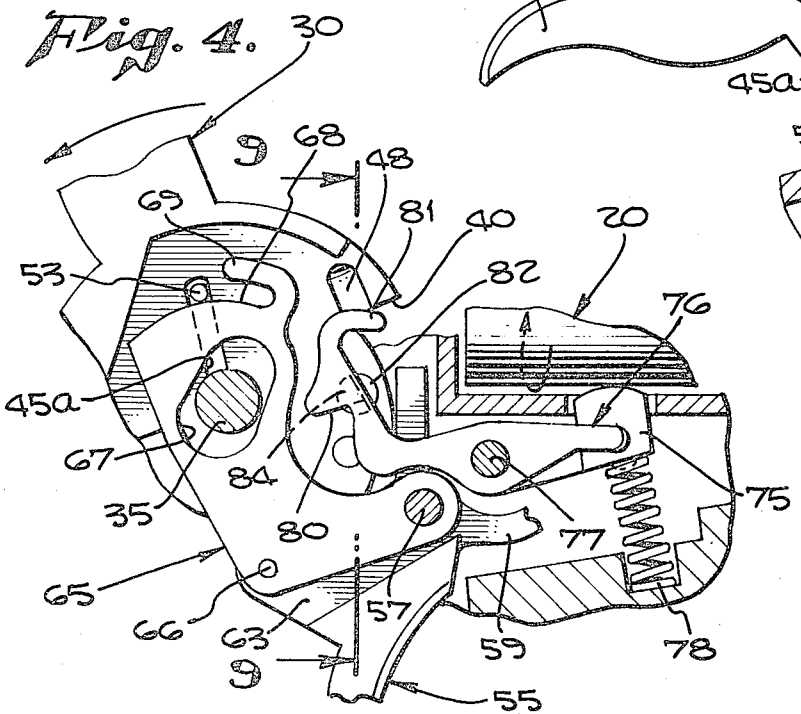
Figure 7:
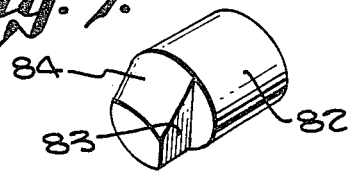
FIG. 7 is a perspective view of a cam button which operates the cylinder latch.

Some portion of the hammer assembly is shown in each of the drawing figures with the exception of FIGS. 7 and 10. Referring particularly to FIGS. 5 and 6, the hammer 30 which is cast as a single piece includes a base part 31 of a roughly semi-cylindrical configuration, an upstanding arm portion 32, and an upwardly and rearwardly extending thumb tab 33. The hammer pivots relative to handle 15 about a pivot pin 35 which is at the radius center of its base portion 31. At the rearward edge of base portion 31 a roller 36 carried on a shaft 37 rolls along the main spring 38. The full extent of main spring 38 is shown in FIG. 1, and its function is to continually urge the hammer in an upward and forward pivotal movement.

Figure 8:
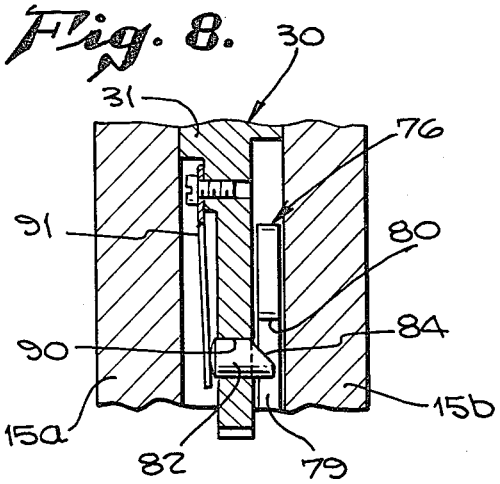
FIG. 8 is a transverse cross-sectional elevational view taken on line 8—8 of FIG. 2, and showing the interrelationship between the cam latch, the hammer, and the cam button which drives the cam latch.
Figure 9:
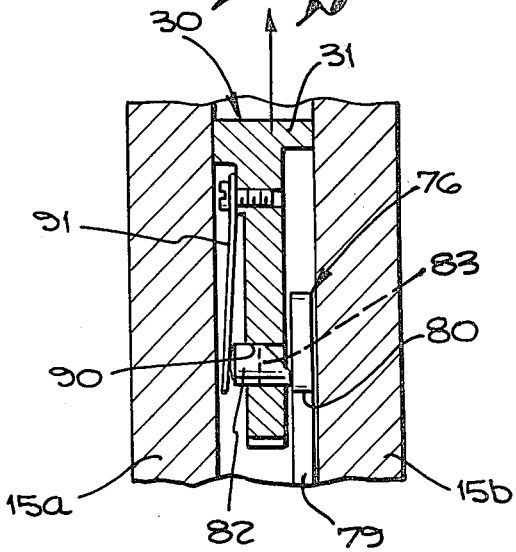
FIG. 9 is a transverse cross-sectional view taken on the line 9—9 of FIG. 4, showing a different relative position of the parts that appear in FIG. 8.

As shown in FIGS. 8 and 9 the hammer base 31 is of about the same lateral thickness as the handle halves 15*a*, 15*b*. However, the greatest part of the base 31 is hollowed out on the sides, in addition to holes and slots, in order to make room for other operating mechanisms, as will be later described.

On its forward side the hammer base 31 has a large notch 40 formed therein, and on its forward and lower extremity has a smaller notch 41 adapted to be engaged by the sear of the trigger. A curved cam surface 42 extends between these two notches.

The general operation of the hammer is as follows. It is normally urged toward the firing position of the firearm as shown in FIG. 6. When the hammer is cocked, by moving thumb piece 33 rearwardly, the upper end of the trigger becomes engaged in the sear notch 41 temporarily locking the hammer in its cocked position. Then the trigger is pulled to release the hammer and fire the weapon.

An important feature of the present invention is the provision of an elongated recess 45 inside the hammer. This recess or slot slidably receives the safety member 50. Recess 45 extends from pivot pin 35 upward to the hammer face 46. It will be noted that in the safety or stored position of the firearm as shown in FIG. 2 the firing pin 25 actually projects into the upper end portion of the recess or slot 45.

The Safety Member

The principal feature of the present invention is safety member 50 shown in perspective in FIG. 10. This member is an elongated cylindrical rod whose upper end is beveled to form a front face 51. Near its lower end it has a lateral side opening 52. A control pin 53 is inserted through the opening 52 and projects outward on both sides of the safety member. See FIGS. 11 and 12. The length of control pin 53 is slightly less than the maximum lateral thickness of the hammer. A small slot or opening 45*a* extends a short distance up the right-hand side of the recess 45 of the hammer, as best seen in FIG. 2. The right-hand end of pin 53 projects through the slot 45*a* and interengages with the safety member cam 65. See FIGS. 11 and 12.

Control pin 53 moving in the slot 45*a* is controlled by the operation of cam 65, to be subsequently described, so as to raise or lower the safety member or auxiliary firing pin 50. When the hammer is forward and the safety member is in the raised or extended position as shown in FIGS. 6 and 12, the front face 51 of the safety member then engages the rear end face 27 of the firing pin. In the lower or retracted position of the safety member as shown in FIGS. 2 and 11 the upper end of the safety member is underneath the firing pin. If the trigger is then pulled, upward movement of the safety member is stopped by its engagement with the under surface 28 of the firing pin.

Trigger Assembly

Trigger 55 is pivotally supported within the frame of the firearm from a pivot pin 57. The handle part 58 of the trigger extends more or less directly downward beneath the cylinder 20, with its forward extremity 59 being urged upward by the trigger spring 60. An upper arm 61 of the trigger carries the sear 62. The trigger also has a rearward arm 63.

The action of trigger spring 60 in conjunction with pivot pin 57 is to normally urge the trigger in the direction of counterclockwise rotation as seen from the right-hand side of the firearm, that is, so that the handle 58 is normally urged forward while the sear 62 is urged rearward. In the safety or stored position of the firearm as shown in FIG. 2 the trigger sear 62 finds ample space within the upper notch 40 of the hammer. In the fully cocked position as shown in FIG. 5 the sear engages the sear notch 41 of the hammer.

The trigger has three different positions which can be clearly identified. The trigger handle is farthest forward when the hammer is down, i.e., in the safety or stored position as shown in FIG. 2. The trigger also has a rearward position as shown in FIG. 5, when the hammer is fully cocked and the trigger sear engages the sear notch 41 of the hammer. It also has a third, even more rearward position, which may be identified as the extreme rearward position. That is the position which the trigger must reach before the sear can become engaged with the sear notch.

Thus in FIG. 4 when the cocking action of the hammer is nearly completed, the trigger is then moving toward its extreme rearward position. When the hammer reaches the cocked position as shown in FIG. 5 the trigger is then moved forward somewhat, to its cocked or rearward position. When the trigger is pulled for firing the weapon, it is again necessary to pull the trigger handle to its extreme rearward position, in order to release the sear from the sear notch.

It will therefore be understood that the curved camming surface 42 of the hammer serves to move the trigger from its forward or safety position to its rearward or cocked position, when the hammer is being cocked.

Safety Member Cam

Figure 3:
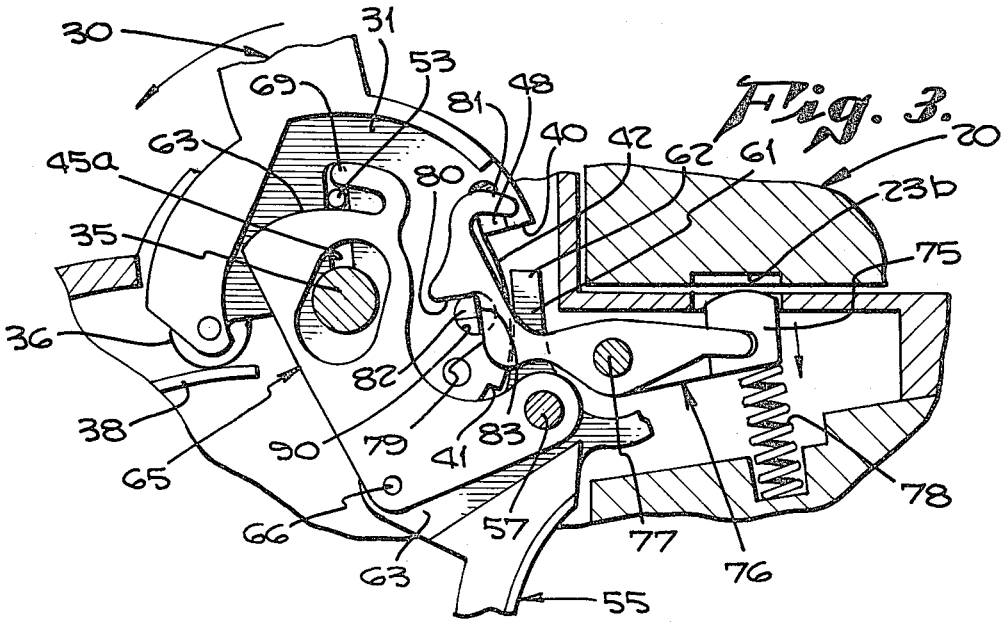
FIG. 3 is a view like FIG. 2, as the hammer is being pulled rearwardly towards a cocked position.

The safety member cam 65 is a relatively thin plate (see FIGS. 11 and 12) which fits within a cutout on the right-hand side of the hammer. As seen in FIGS. 2 and 3 it is a somewhat L-shaped member. Its lower forward extremity is received on the trigger pivot pin 57. Its lower rear corner is fastened to the rear leg 63 of the trigger by means of a fastening pin 66. Being fastened to the trigger by means of the two pins 57 and 66, the safety member cam 65 at all times moves with the trigger.

A somewhat elliptical opening 67 is formed in the upper part of the cam 65, and its only purpose is to provide clearance about the pivot pin 35 of the hammer. On its upper end the cam 65 has a curved camming surface 68 whose function is to drive the control pin 53 and hence the safety member 50 upward at the appropriate times. At its upper extremity the cam has a hook 69 which draws the control pin back downward when the safety member is to be retracted.

Cylinder Advance

The rotational advance of cylinder 20 from one firing position to the next is accomplished by generally conventional means, utilizing a hand or pawl carried on the left-side of the hammer. The hand 70 is seen in dotted lines in FIG. 2 only. It engages an end notch, not specifically shown, on the rearward end of the cylinder 20, for rotatingly driving the cylinder to its next firing position. A spring 71 associated with the hand 70 is also shown in dotted lines, in FIG. 2 only.

Cylinder Latch

The cylinder latch 75, shown for example, in FIGS. 2 and 5, engages one of the noches 23*a* . . . 23*e* in the outer periphery of cylinder 20. Latch 75 is affixed to the forward end of a latch cam 76 which is of a somewhat L-shaped configuration. Latch cam 76 in turn is supported by a pivot pin 77 that is carried by the frame or housing of the firearm. The latch 75 together with the forward arm of the latch cam is urged upward by a coil spring 78 seated within the lower extremity of main housing 10.

Near its rearward end the latch cam 76 has two adjoining shoulders which are essentially perpendicular to each other. A vertical shoulder 79 turns outward at its upper end to form a horizontal shoulder 80. These shoulder surfaces are utilized for actuating the latch cam by means of cam button 82 shown in FIG. 7. A hook 81 on the upper extremity of the latch cam cooperates with the loading gate in a unique manner, as will later be described.

The cam button 82 is received in a lateral hole 90 formed in the hammer base 31. See FIGS. 8 and 9. The left-hand end of the button is retained by a retaining spring 91.

The initial cocking movement of the hammer, FIG. 3, causes a flat end surface 83 of the cam button 82 to bear hard against the shoulder 79 of the latch cam. This produces a rapid and positive action to unlock the cylinder. Further movement of the hammer causes the sloped end surface 84 of the cam button to cam against the horizontal shoulder 80 of the latch cam, with the result that the cam button is laterally withdrawn out of the plane of the latch cam and into the position shown in FIGS. 4 and 9. After firing takes place the cam button returns to its original position as shown in FIGS. 6 and 2.

When the cylinder is first unlocked as shown in FIG. 3 the hand 70 is rotating the cylinder to the next firing position. By the time cam button 82 is withdrawn out of engagement with the latch cam the cylinder has rotated sufficiently so that the latch 75 is no longer engaging the initial one of the notches. See FIG. 4. When the hammer becomes fully cocked as shown in FIG. 5 the cylinder has completed its rotation to the next firing chamber location and the latch 75 then engages the next succeeding one of the cylinder notches.

Loading Gate and Safety Interlock

Figure 14:
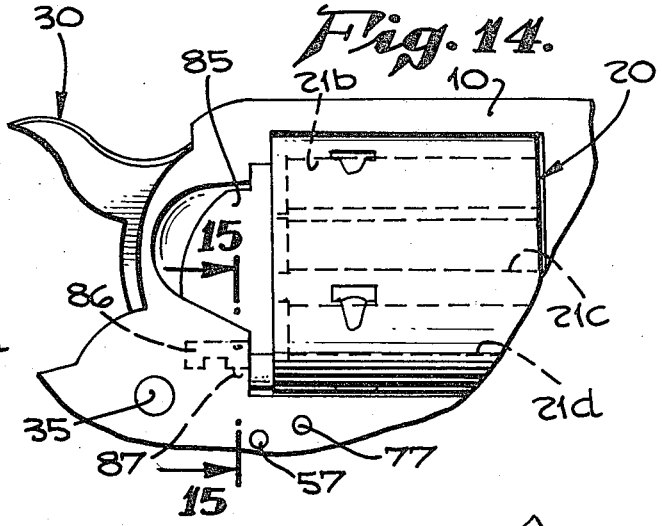
FIG. 14 is a side elevation view of the parts shown in FIG. 13.
Figure 15:
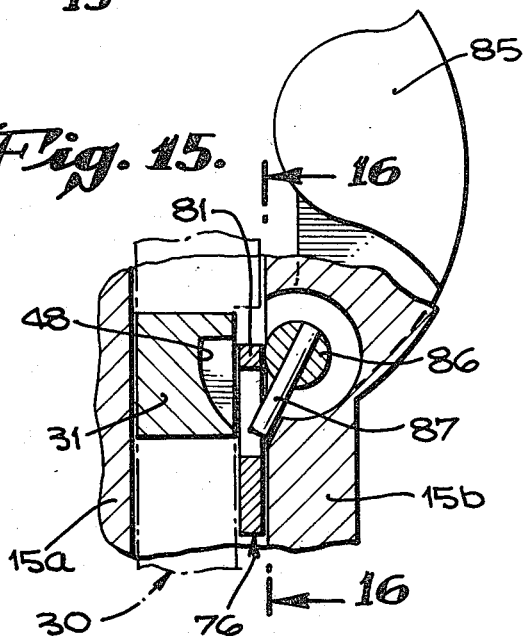
FIG. 15 is a cross-sectional view taken on line 15—15 of FIG. 14.
Figure 16:
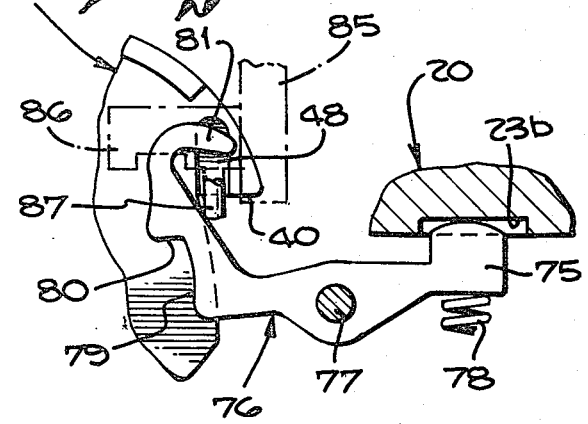
FIG. 16 is a side elevation view of the cylinder latch cam and related parts, taken on line 16—16 of FIG. 15.
Figure 18:
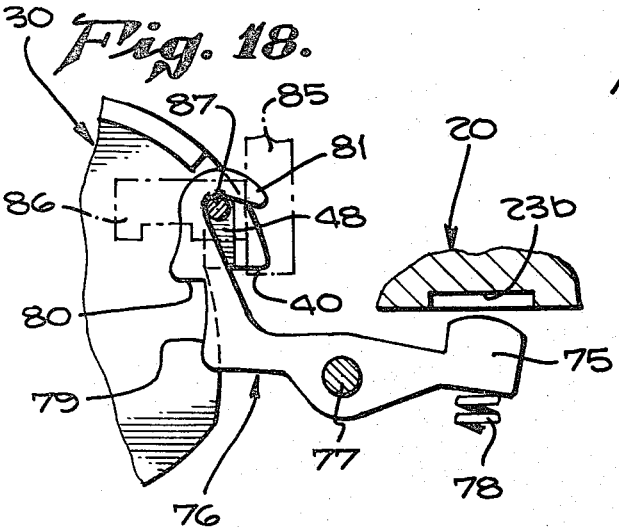
FIG. 18 is a view like FIG. 16 but showing the cylinder latch disengaged.

Loading gate 85, FIG. 14, is pivotally supported on a pivot shaft 86 that extends rearwardly of the cylinder 20 within the frame or housing of the firearm. Shaft 86 also carries an interlock pin 86 which, in the closed position of the gate as shown in FIG. 15, is inclined at an angle of about 22 degrees from the vertical. This interlock pin is adapted to engage with the hook 81 on the upper extremity of the cam latch.

Figure 17:
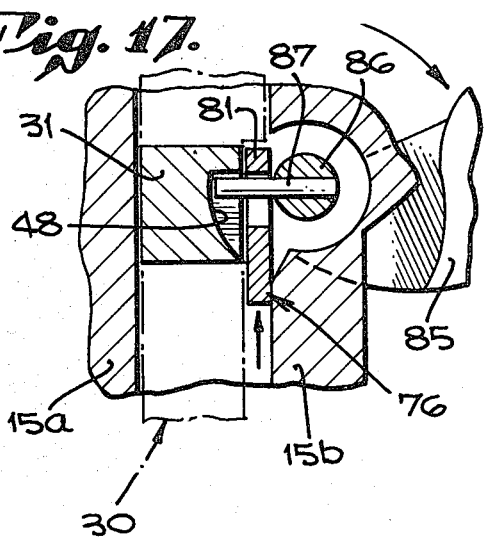
FIG. 17 is a view like FIG. 15 but showing the latch cam raised by the rotating gate pin.

A curved recess 48 is provided in the base part 31 of the hammer so that interlock pin 87 may enter therein. See FIGS. 2, 6, 15 and 17. As shown in FIG. 17, completing the rotation of gate 85 to the fully open position causes interlock pin 87 to raise the hook 81. This provides a sufficient movement of the latch cam so as to unlock the cylinder. See FIG. 18. It is then possible to freely rotate the cylinder so as to load all of its chambers.

It is only in the safety position of the hammer, however, that the interlock pin 87 is effective in the manner just described. Thus in the fully cocked position of the hammer as shown in FIG. 5 the interlock pin 87 strikes another portion of the hammer, inside the cam surface 42, which has no cutout. The result is that in the fully cocked position of the hammer the loading gate cannot be opened. In fact, the location of the cutout 48 is such that the loading gate can be opened only when the hammer is in its safety or stored position.

Because of this feature the herein illustrated firearm does not require a separate loading position. It has only two positions of rest, the fully cocked position and the safety or stored position. Elimination of the conventional loading position of the hammer has also eliminated some of the safety hazards associated therewith.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. In a firearm having an external pivotally mounted hammer that is adapted to be manually cocked, a trigger pivotally mounted below the hammer, a cartridge-receiving chamber in front of the hammer, a firing pin associated with the hammer and mounted in position to strike and fire a cartridge in the chamber, a cam surface on the hammer which contacts and rotates the trigger from its rest position to its ready-to-fire position as the hammer is being cocked, a sear notch in the hammer, a sear for the trigger, and a trigger spring which pivots the trigger to engage the sear in the sear notch when the hammer is fully cocked, the safety improvement which comprises:

an elongated recess formed wihin the hammer such that when the hammer is adjacent the firing pin, an end portion of said recess is juxtaposed to the firing pin and the hammer itself does not engage the firing pin;

an elongated safety member disposed within said recess and slidably movable therein between upwardly extended and downwardly retracted positions, the extended position of said safety member being such that forward movement of the hammer will drive said safety member into contact with the rear end face of the firing pin and thereby fire the cartridge;

a safety member cam disposed beside the hammer and coupled to said safety member for controlling the extending and retracting movement thereof, said safety member cam being secured to the trigger to move therewith;

the firearm being characterized by the firing pin projecting rearwardly from the chamber housing and said safety member in its retracted position being adapted to engage the underside of the firing pin but not the rear end face thereof; and the operation of said safety member cam being such as to move said safety member from its retracted position to its extended position when the trigger is rotated from its rest position to its ready-to-fire position;

whereby when the trigger is pulled the kinetic energies of the hammer and said safety member are combined for striking the firing pin to fire the cartridge, but after the trigger has been released the subsequent application of pulling force to the trigger is not effective to insert the upper end portion of said safety member into the space behind the rear end face of the firing pin.

2. Apparatus as in claim 1 which further includes a control pin secured to one side of said safety member, wherein an elongated slot is also formed in the hammer and aligned parallel to said recess for permitting longitudinal movement of said control pin, wherein said safety member cam is in the form of a relatively thin plate disposed parallel to the hammer, and wherein said cam has an elongated camming surface for driving said pin upward and a hook for pulling said pin downward.

3. Apparatus as in claim 1 wherein said elongated safety member is in the form of a cylindrical rod having a flattened end face.

4. Apparatus as in claim 1 wherein said safety member cam is in the form of a relatively thin plate disposed parallel to the hammer, and which includes a pivot pin supporting the hammer, said safety member cam having an enlarged opening which fits about said pivot pin.

* * * * *